US005345957A

United States Patent [19]

Cooper et al.

[11] Patent Number: 5,345,957

[45] Date of Patent: Sep. 13, 1994

[54] DISHWASHER FILTER ARRANGEMENT

[75] Inventors: Randall L. Cooper; Rodney M. Welch, both of Newton, Iowa

[73] Assignee: Maytag Corporation, Newton, Iowa

[21] Appl. No.: 117,730

[22] Filed: Sep. 7, 1993

[51] Int. Cl.[5] ..... A47L 15/22; A47L 15/42

[52] U.S. Cl. ..... 134/104.1; 134/111; 210/167; 210/314; 210/411

[58] Field of Search ..... 134/104.1, 111; 210/167, 314, 316, 411

[56] References Cited

U.S. PATENT DOCUMENTS

| | | | |
|---|---|---|---|
| 2,287,628 | 6/1942 | McMahan | 134/111 X |
| 2,681,658 | 6/1954 | Meeker et al. | 134/111 |
| 2,862,510 | 12/1958 | Geiger et al. | 134/111 |
| 3,322,285 | 5/1967 | Lopp | 210/314 |
| 3,335,867 | 8/1967 | Perl | 134/111 |
| 3,502,090 | 3/1970 | Grunewald | 134/111 |
| 4,085,761 | 4/1978 | Grunewald | 134/104.1 |
| 4,150,679 | 4/1979 | Cushing et al. | 134/104.1 |
| 4,150,680 | 4/1979 | Johnson | 134/176 X |
| 4,243,431 | 1/1981 | Dingler et al. | 134/104.1 |
| 4,468,333 | 8/1984 | Geiger | 210/798 |
| 4,612,947 | 9/1986 | Duncan | 210/167 X |
| 4,754,772 | 7/1988 | Nord et al. | 134/111 |
| 4,969,479 | 11/1990 | Lagerstrand | 134/108 |
| 4,972,861 | 11/1990 | Milocco et al. | 134/104.1 |
| 4,998,548 | 3/1991 | Lagerstrand | 134/111 |
| 5,031,650 | 7/1991 | Nagata et al. | 134/111 |
| 5,097,855 | 3/1992 | Martinsson et al. | 134/57 D |
| 5,165,433 | 11/1992 | Meyers | 134/104.4 |

*Primary Examiner*—Philip R. Coe

*Attorney, Agent, or Firm*—Zarley, McKee, Thomte, Voorhees & Sease

[57] ABSTRACT

A water circulation system for a dishwasher is provided, and includes a pump housing with a cover mounted in the bottom wall of the washing chamber of the dishwasher. The cover includes a collection chamber with a strainer portion extending around the outside of the chamber, and a filter element positioned on the inside of the chamber. A first portion of the wash water passes through the strainer, which removes large food particles from the water, which is then recirculated by a pump in the pump housing back to the washing chamber. A second portion of wash water is collected in the collection chamber and passes through the filter element to remove food particles therefrom, and then into the pump housing for recirculation by the pump to the washing chamber. The collection chamber includes a drainage outlet for draining collected food particles from the chamber at the end of the wash cycle. A backwash spray of water is also provided to continuously backwash the filter element during the washing cycle so as to prevent clogging of the element.

18 Claims, 6 Drawing Sheets

DISHWASHER FILTER ARRANGEMENT

BACKGROUND OF THE INVENTION

Dishwashers have a washing chamber including side walls, a top wall and a bottom wall, and a water circulation system mounted in the bottom wall of the washing chamber. The circulation system pumps water upwardly through a rotating wash arm for spraying water onto the dishes and other objects to be cleaned within the washing chamber. Typically, the water sprayed from the wash arm collects in the bottom of the washing chamber and is strained so as to remove large food particles from the water. The strained water is then recirculated by the circulation system for further spraying of the dishes.

A problem associated with conventional dishwasher circulation systems is that smaller food particles pass through the strainer, and thus through the circulation system. These smaller food particles recirculate in the circulation system and tend to become redeposited on the dishes and other articles being washed.

SUMMARY OF THE INVENTION

An objective of the present invention is an improved water circulation system for dishwashers.

Another objective of the present invention is the provision of a water circulation system for dishwashers having a filter for removing some of the small food particles from the wash water prior to recirculation of the water into the washing chamber.

A further objective of the present invention is the provision of a water circulation system for dishwashers having both a strainer portion and a filter portion.

Still another objective of the present invention is the provision of a dishwasher filter arrangement which filters wash water fed from the wash arm and which is backwashed during the washing cycle.

Yet another objective of the present invention is the provision of a dishwasher filter arrangement having a collection chamber for collecting small food particles and for disposing of the small food particles after the washing cycle is completed.

Another objective of the present invention is the provision of an improved combination strainer and filter apparatus for a dishwasher which allows simple model differentiation during manufacturing and which can be retrofit to existing dishwashers.

A further objective of the present invention is the provision of a method of circulating wash water in a dishwasher wherein a first portion of the wash water is strained to remove large food particles therefrom, and a second portion of the wash water is filtered to remove smaller food particles therefrom, prior to recirculation of the wash water back to the washing chamber.

The water circulation system of the present invention is an improvement over existing circulation systems in dishwashers. The water circulation system is included in a dishwasher having a washing chamber, a pump housing and a pump within the pump housing for supplying wash water to the washing chamber to clean objects therein. A strainer is provided for straining large objects from the wash water and defines a first water recycling inlet into the pump housing for recirculation of wash water to the washing chamber by the pump. The water circulation system also includes a filter for filtering food particles from the wash water and defining a second water recycling inlet into the pump housing for recirculation of wash water to the washing chamber by the pump. A collection chamber is positioned adjacent the filter to collect food particles filtered from the wash water.

DETAILED DESCRIPTION OF THE PREFERRED EMBODIMENT

Figure 1:
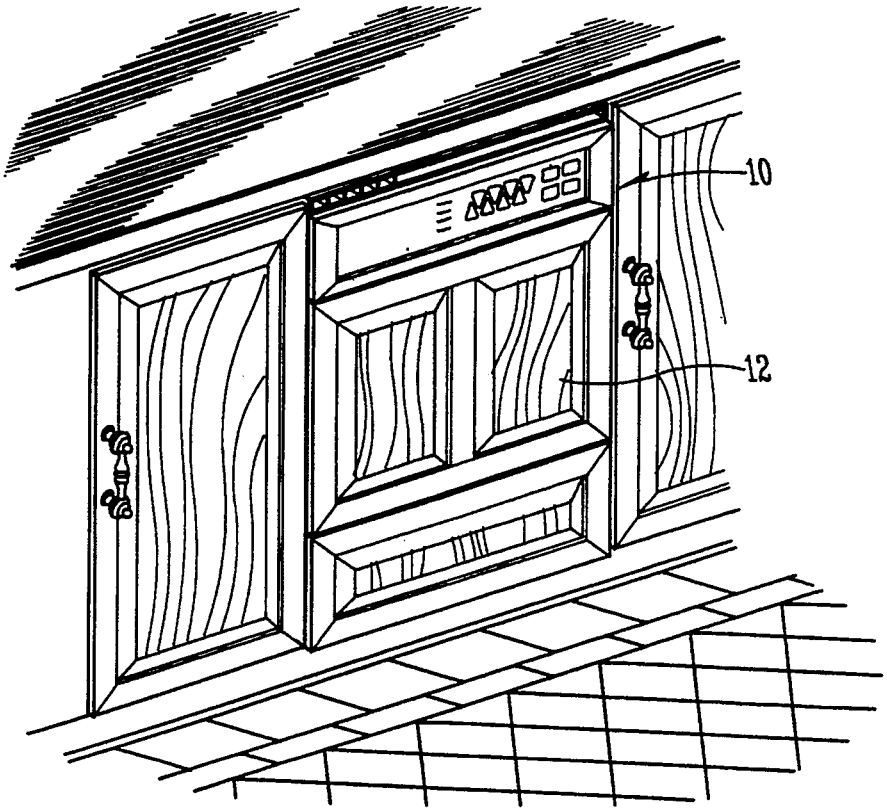
FIG. 1 is a perspective view showing the front door of a dishwasher in a closed position.
Figure 2:
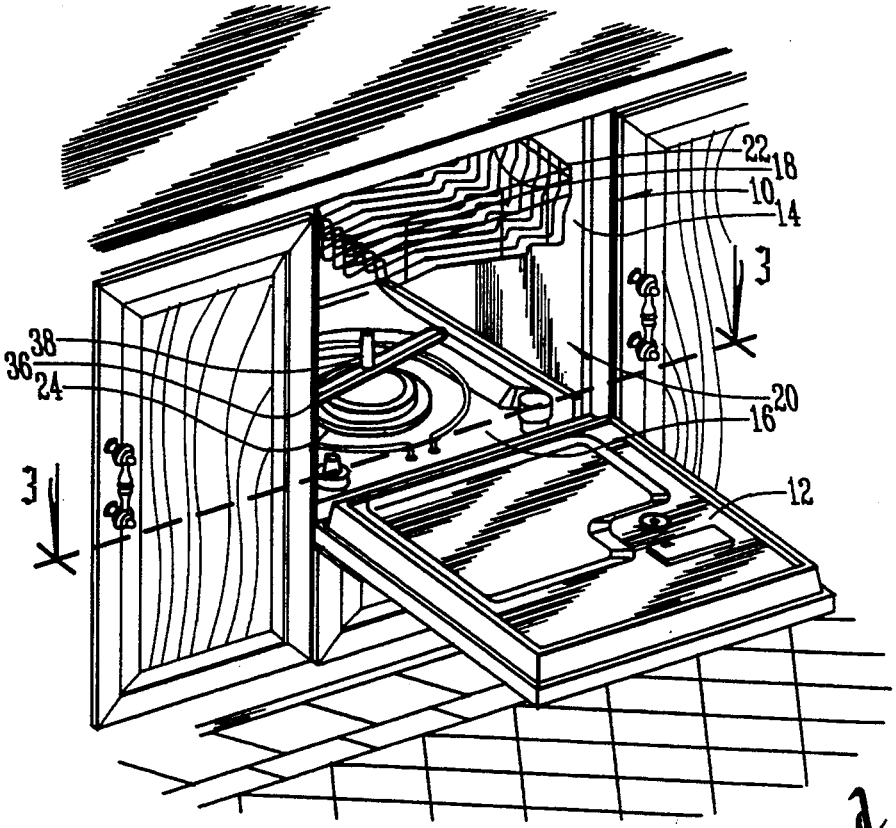
FIG. 2 is a view similar to FIG. 1 showing the dishwasher door in an open position.
Figure 3:
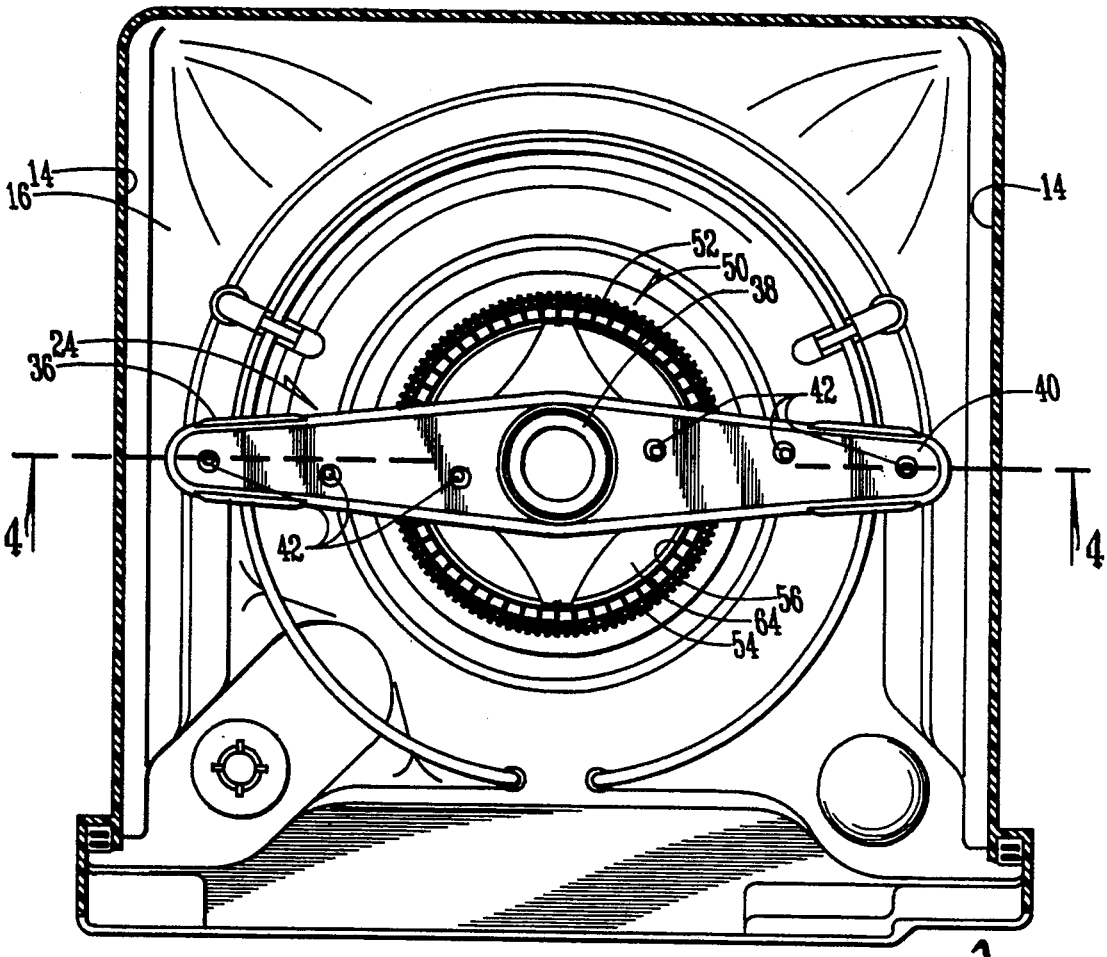
FIG. 3 is a sectional view taken along lines 3—3 of FIG. 2.
Figure 4:
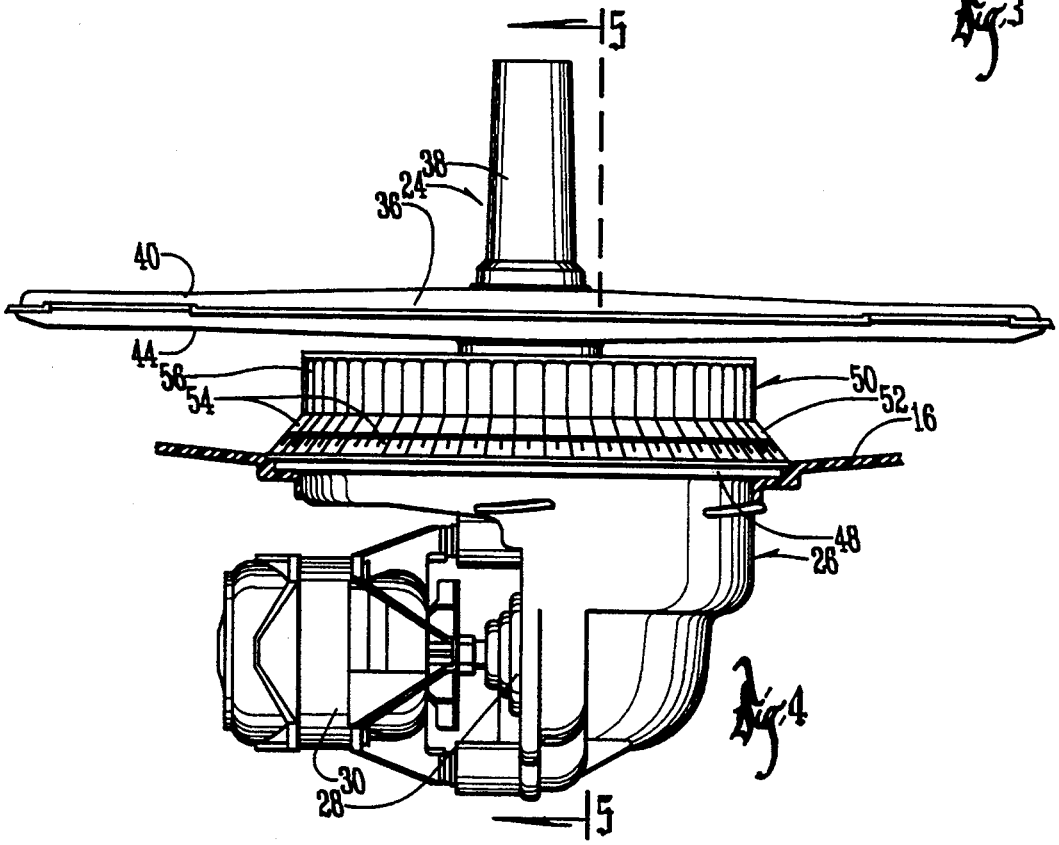
FIG. 4 is a sectional view taken along lines 4—4 of FIG. 3.

With reference to the drawings, a dishwasher 10 is shown in FIGS. 1 and 2. The dishwasher includes a door 12 pivotally movable between the closed position shown in FIG. 1 and the open position shown in FIG. 2. The dishwasher 10 further includes sidewalls 14, a bottom wall 16, and a top wall 18 which together define a washing chamber 20. An upper rack 22 is provided within the washing chamber 20, and a lower rack is typically provided, but is not shown in FIG. 2 for purposes of clarity. The above-described structure of the dishwasher 10 is conventional, and does not form a part of the present invention.

The present invention is directed towards a water circulation and filtration system 24 which is mounted in the bottom wall 16 of the dishwasher 10. The details of the circulation system 24 are shown in FIG. 3–10.

More particularly, the water circulation and filtration system 24 includes a pump housing 26, a pump 28 mounted within the housing 26, and a motor 30 operatively connected to the pump 28.

Figure 5:
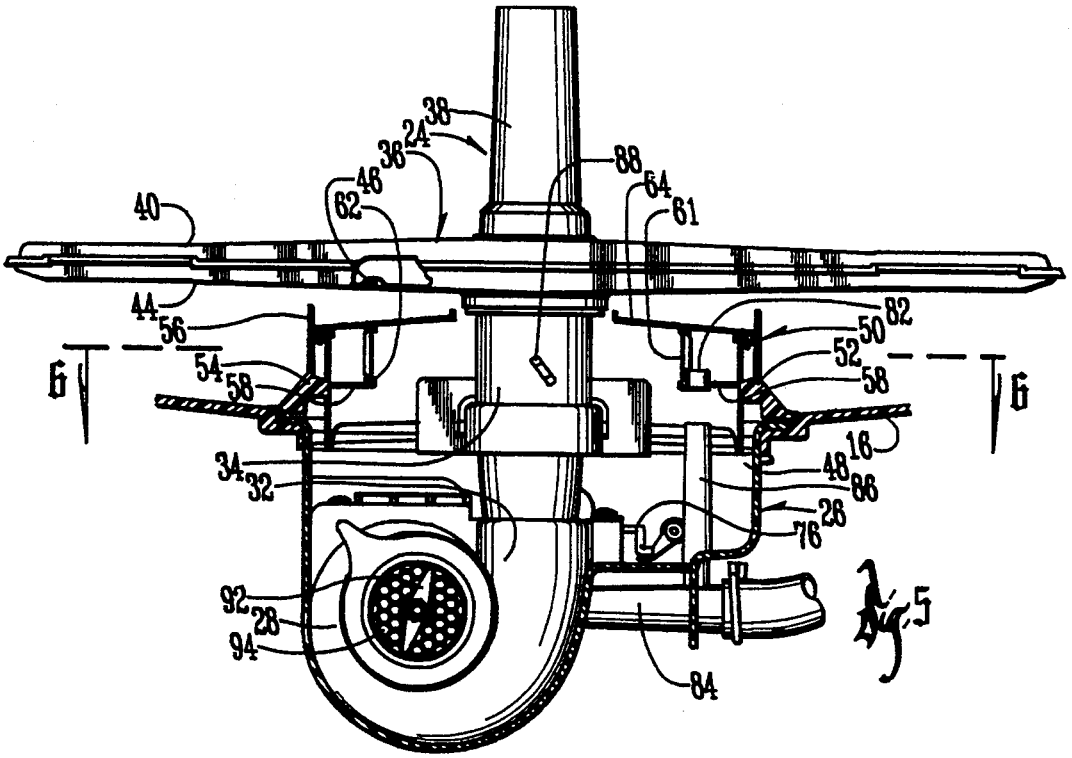
FIG. 5 is a sectional view taken along lines 5—5 of FIG. 4.
Figure 7:
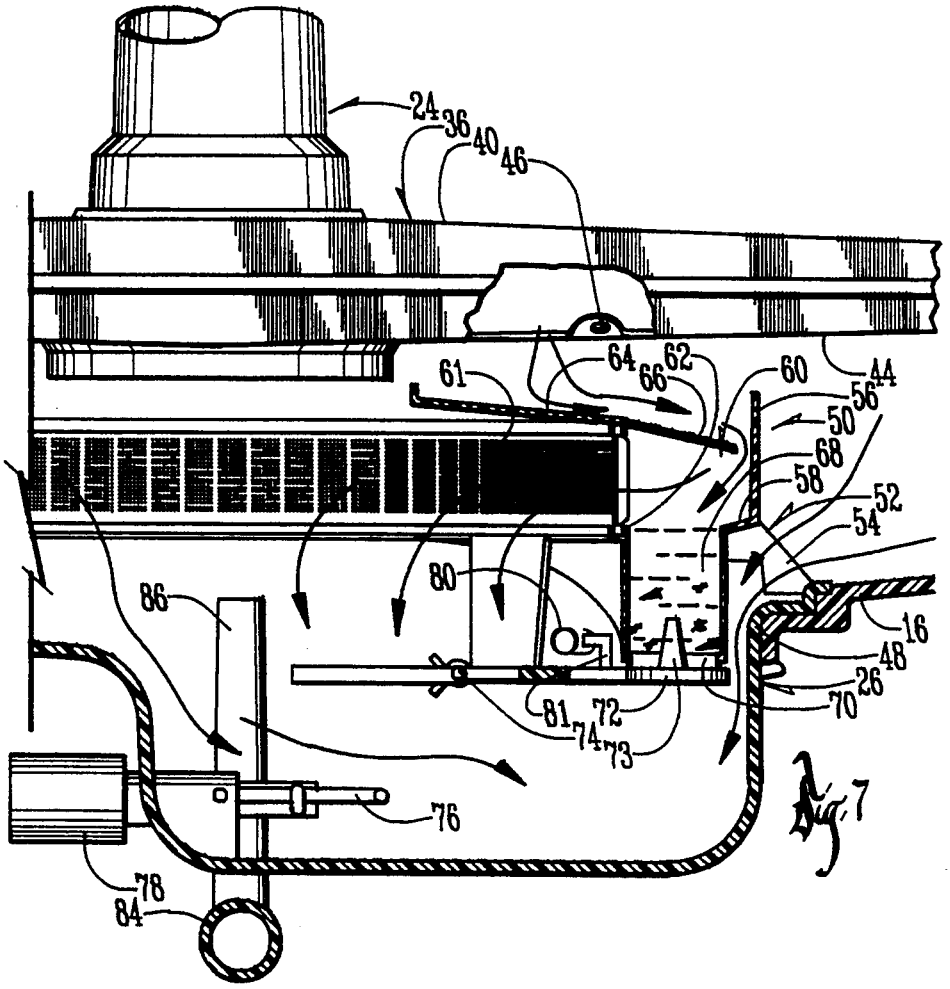
FIG. 7 is an enlarged partial sectional view taken along lines 7—7 of FIG. 6, and showing the closure flap in a closed position.

The pump 28 provides wash water to a pump volute 32. A wash arm support 34 is rotatably mounted upon the volute 32. An elongated wash arm 36 is mounted on the wash arm support 34 for rotation therewith and is secured with a spray nozzle 38 received on the wash arm support 34. A jump up nozzle (not shown) is operatively mounted within the spray nozzle 38. The wash arm 36 includes an upper surface 40 having a plurality of spray apertures 42 extending along the length of the wash arm 36. As best shown in FIGS. 5 and 7, the wash arm 36 also includes a lower surface 44 with a single aperture 46 therein.

The pump housing 26 has an open upper end 48 which is covered with an annular filter assembly 50.

The filter assembly 50 includes a strainer portion 52 extending around the parameter edge of the assembly. The strainer portion 52 includes a plurality of openings 54 through which wash water from the washing chamber 20 may pass into the pump housing 26 for recirculation by the pump 28 through the volute 32, arm support 34, and wash arm 36 and back into the washing chamber 20. The strainer portion 52 keeps large objects including silverware from passing therethrough into the pump housing 26.

An upstanding cylindrical wall 56 and a bottom wall 58 are spaced radially inwardly from the strainer portion 52, and surround the wash arm support 34. The cylindrical wall 56 and the bottom wall 58 define a collection chamber 60 for collecting food particles, as described below. An annular filter element 61 is received within a slot 62 in the bottom wall 58. An annular cap 64 having a downwardly sloped upper surface 66 snap fits onto the wall 56 so as to cover the filter element 61. The perimeter edge of the cap 64 is spaced apart from the cylindrical wall 56 so that wash water and food debris directed through aperture 46 as well as wash and food debris dropping onto the cap 64 from within washing chamber 20 will flow down the sloped surface 66 into the collection chamber 60. The filter element 61 has a plurality of fine apertures which allow wash water collected within the collection chamber 60 to pass therethrough while the food particles are retained in the collection chamber 60. Thus, the wash water in the collection chamber 60 is filtered by the filter element 61 before passing into the pump housing 26 for further circulation through the pump volute 32, the wash arm support 34 and the wash arm 36 back into the washing chamber 20 for cleaning the dishes therein.

Figure 6:
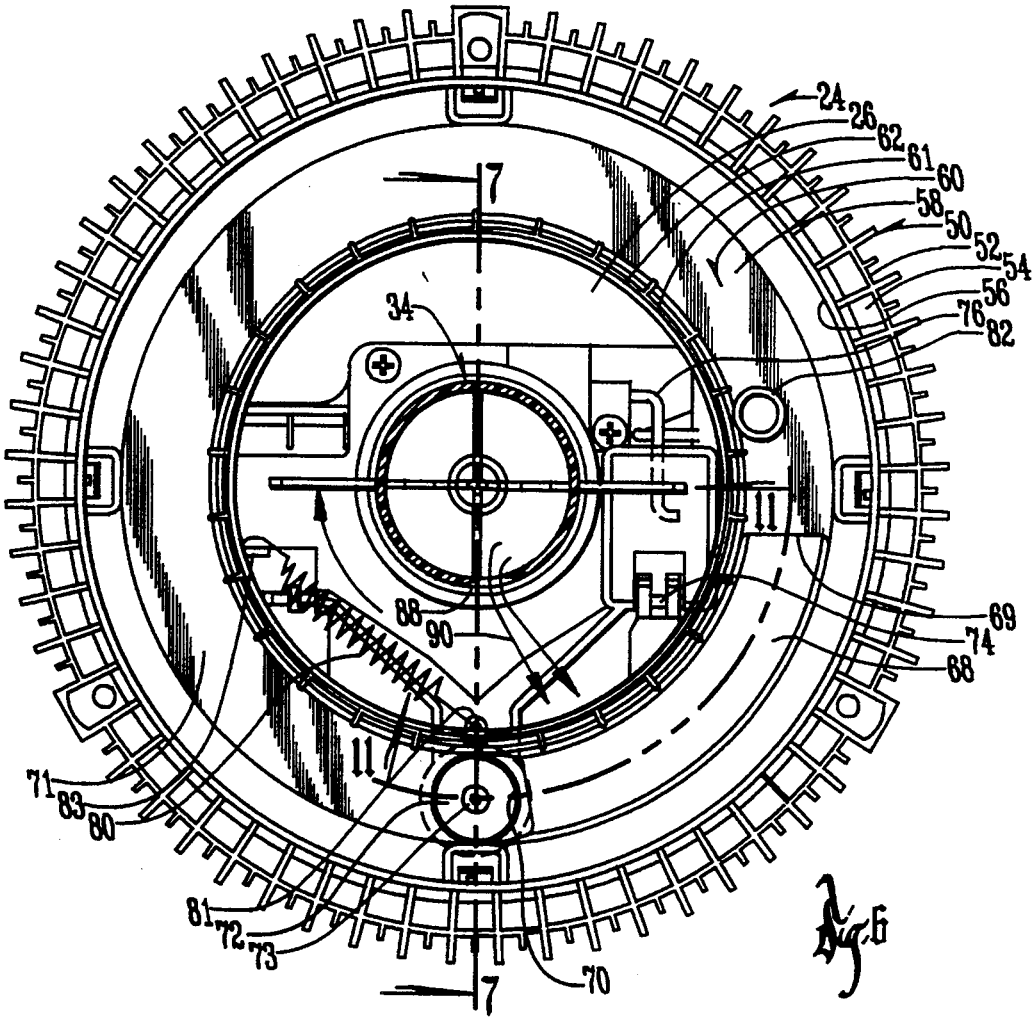
FIG. 6 is a sectional view taken along lines 6—6 of FIG. 5.
Figure 11:
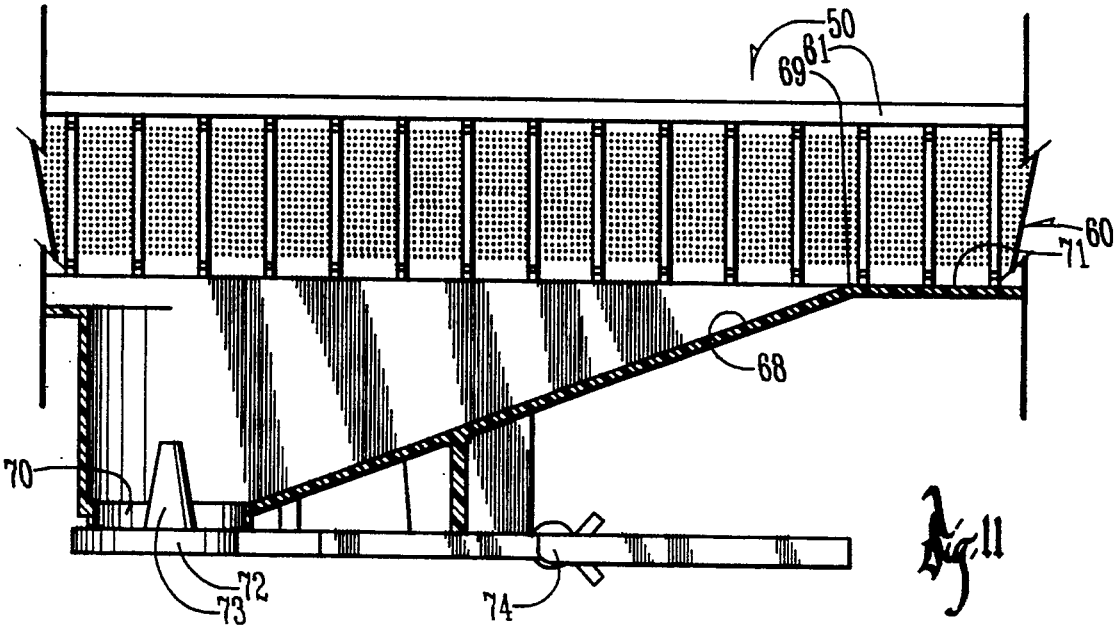
FIG. 11 is a fragmentary sectional view taken generally along lines 11—11 of FIG. 6.

As best shown in FIGS. 6 and 11, the bottom wall 58 includes a first ramped or sloped portion 68 which extends steeply downward in a clockwise direction from the high point 69 of the bottom wall 58 to a discharge opening 70. The bottom wall 58 also includes a second ramped or sloped portion 71 which extends downwardly in a counterclockwise direction for an angular distance of approximately 270 degrees from the high point 69 of the bottom wall 58 to the discharge opening 70. In this distance, the second sloped portion 71 slopes downwardly approximately three-eighths of an inch from the high point 69. The area of the collection chamber 60 defined by the first sloped portion 68 captures the majority of the food debris adjacent the opening 70.

Figure 8:
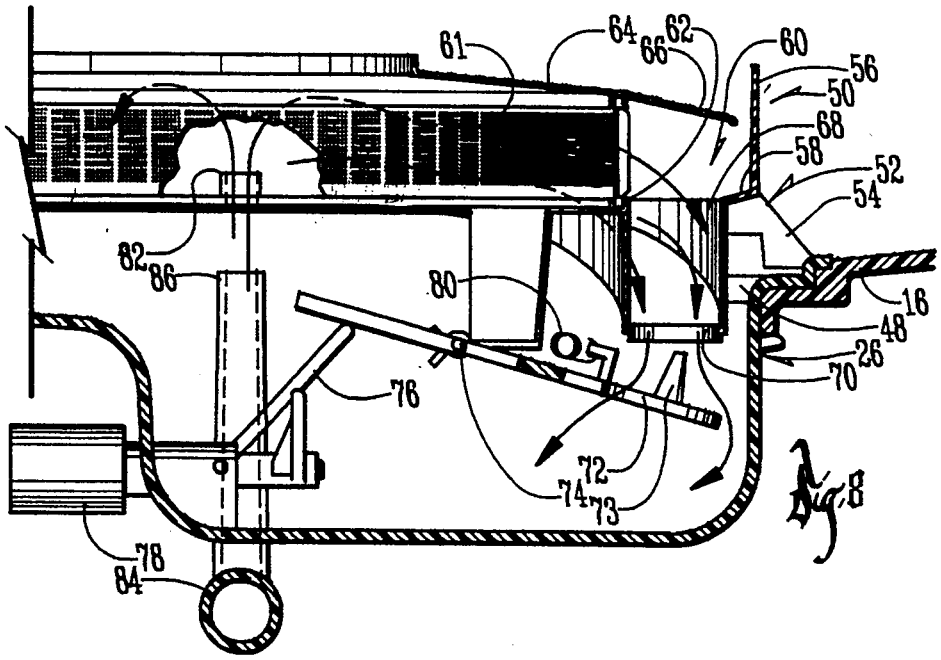
FIG. 8 is a view similar to FIG. 7 showing the closure flap in an open position.

A closure flap 72 is pivotally mounted about an axis 74 within the pump housing 26 for movement between a closed position sealing discharge opening 70, as shown in FIG. 7, and an open position spaced apart from the discharge opening 70, as seen in FIG. 8. The end of the closure flap 72 located in juxtaposition to the discharge opening includes a cone shaped protrusion 73. The protrusion 73 extends through the opening 70 and upwardly into the food debris captured in the vicinity of opening 70. As the closure flap 72 is opened, as shown in FIG. 8, the protrusion 73 will tend to start the flow of food from the collection chamber 60 by creating an opening in the debris or loosening any compaction around the discharge opening 70. The movement of the closure flap 72 is controlled by a lever arm 76 which is actuated by a solenoid 78 operatively connected to controls (not shown) of the dishwasher 10. As best shown in FIG. 6, spring 80 extends between attachment point 81 on the closure flap 72 and attachment point 83 which extends downwardly from the bottom wall 58 and normally biases the closure flap 72 to the closed position.

The bottom wall 58 of the collection chamber 60 includes a flush port 82. The pump housing 26 includes a water discharge line 84, with an upstanding pipe 86 extending upwardly therefrom. The pipe 86 is aligned beneath the flush port 82 such that when the pump housing 26 is drained at the end of the washing cycle of the dishwasher, a quantity of wash water is forced upwardly through the pipe 86 and the flush port 82 for flushing the collection chamber 60 including the first and second portions 68 and 71, thereby removing all of the collected food particles through the discharge opening 70.

Figure 9:
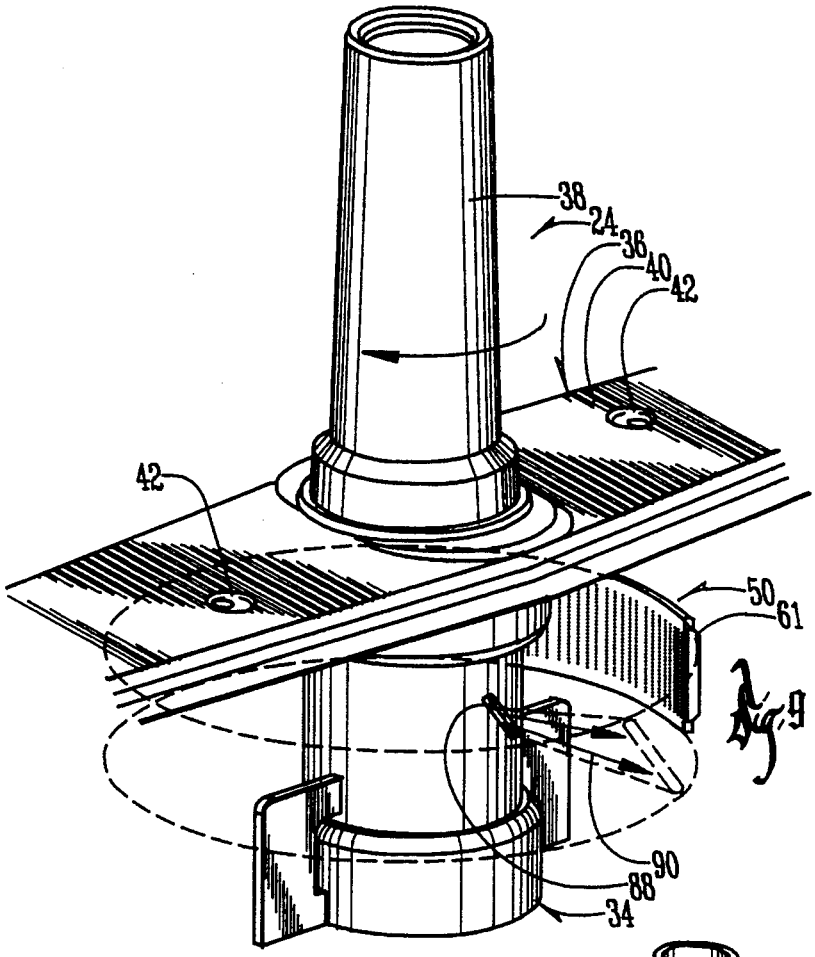
FIG. 9 is a partial perspective view illustrating the backwash system for the filter element.
Figure 10:
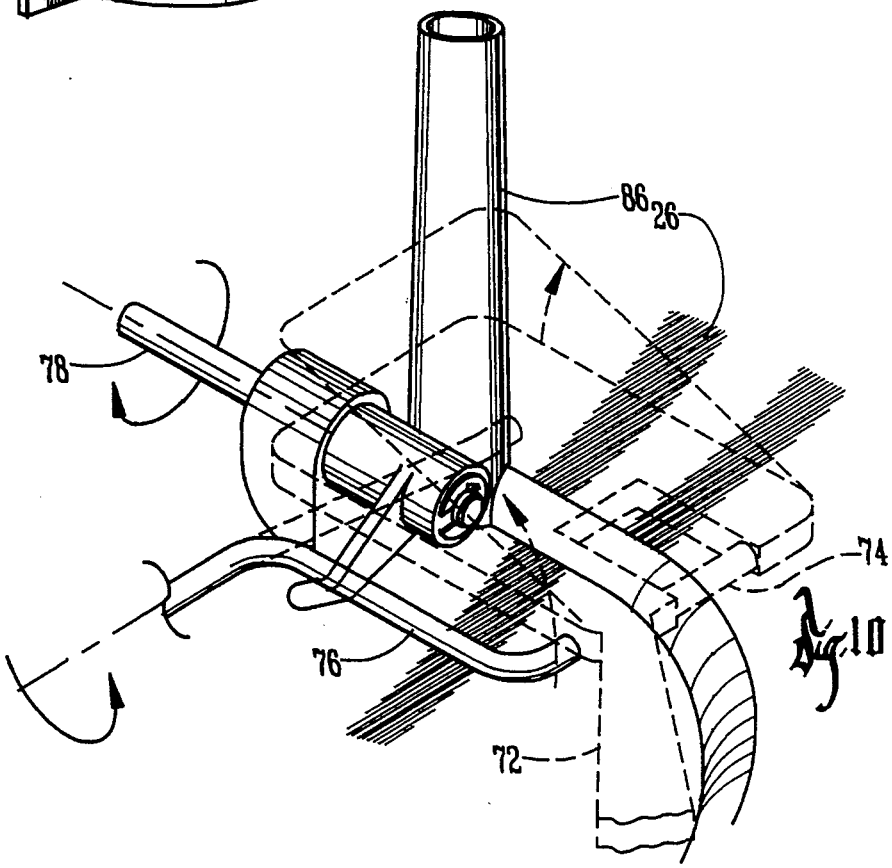
FIG. 10 is a partial perspective view showing the actuator arm for the closure flap.

The wash arm support 34 includes a small aperture 88, as best seen in FIG. 5 and 9. The aperture 88 is elongated an angled with respect to the longitudinal axis of the support 34. The opposite ends of the aperture 88 are chamfered. The aperture 88 provides an expanding spray or jet of water, as represented by arrows 90 in FIG. 9, which continuously backwashes the filter element 61 when water is pumped through the wash arm support 34. Since the wash arm support 34 rotates while water is being pumped therethrough, the aperture 88 directs the spray of water 90 along the entire inner surface of the filter element 61 to remove small food particles from the apertures in the filter element 61, so as to prevent clogging of the filter element 61.

In operation, water is supplied to the washing chamber 20, and flows through the filter assembly 50 to the pump 28. The pump 28 forces the water upwardly through the volute 32, the wash arm support 34, and the wash arm 36. The water is sprayed from the wash arm 36 through the spray apertures 42 on the upper surface 40 of the wash arm 36, and through the spray nozzle 38 and jump up nozzle (not shown) for cleaning dishes and other objects contained within the washing chamber 20. The wash arm support 34 and wash arm 36 rotate when water is ejected therefrom due to the shape and location of the spray apertures 42. A quantity of the recirculating wash water is directed through the bottom aperture 46 on the lower surface 44 of the wash arm 36 for continuously providing a portion of the wash water to be deposited on the sloped upper surface 66 of the annular cap 64. Approximately 1/13 of the water recirculated through the wash system is directed through the lower aperture 46 onto the sloped surface 66.

As the initial quantity of water from the pump 28 is sprayed from the wash arm 36 and nozzles 38, the water impinges upon the dishes and other objects to remove food particles therefrom. A first portion of the water flows through the bottom aperture 46 on the lower surface 44 of the wash arm 36 and is directed onto the cap 64 and flows down the sloped surface 66 thereof into the collection chamber 60. The water filters through the filter element 61 so as to remove food particles therefrom. The water then passes into the pump housing 26 and through a chopper 92 and chopper plate 94 into the pump 28, for further circulation to the washing chamber 20. In addition to directing wash water and food particles toward collection chamber 60, the flow through aperture 46 will provide a cleaning and flushing action of sloped surface 66.

A second portion of the wash water collects in the bottom of the washing chamber 20 and passes through the strainer portion 52 of the filter assembly 50, thereby removing large objects from the wash water. The strained wash water passes into the pump housing 26, and through the chopper 92 and chopper plate 94 into the pump 28, for further circulation to the washing chamber 20. The chopper 92 cuts up any food particles which pass through the strainer portion 52.

With the water circulation and filtration system 24, the water is repeatedly filtered as it recirculates through the pump 28 for the sequential wash and rinse cycles of the dishwasher 10. During the first wash cycle, large particles in the water are removed by the strainer portion 52, while smaller particles pass through the strainer portion. The water with small particles is pumped by the pump 28 back through the wash arm 36 for ejection through apertures 42 and 46. The water with small particles which flows down the sloped cap 64 is filtered by the filter element 61 to remove the small particles. This process continues, such that the recirculating water becomes progressively cleaner as large particles are removed by the strainer portion 52 and small particles are removed by the filter element 61.

At the completion of the wash cycle, the solenoid 78 is actuated so as to raise the lever arm 76, which engages the rearward end of the closure flap 72, as seen in FIG. 8. The closure flap 72 thus pivots about the axis 74 so as to be disengaged from the discharge opening 70 in the bottom wall 58 of the collection chamber 60. At the same time that the solenoid 78 is actuated, wash water within the pump housing 26 is being drained through the discharge line 84. As water passes through the discharge line 84, a quantity thereof is forced upwardly through the pipe 86 and through the flush port 82 in the bottom wall 58 of the collection chamber 60, thereby flushing food particles from the collection chamber 60 for discharge through the opening 70 into the pump housing 26 for drainage from the circulation system.

An advantage of the present dishwasher filter arrangement is that the filter assembly 50 including the strainer portion 52, the collection chamber 60, flap 72 and annular cap 64 is an integral assembly completely separate from the pump 28. The filter assembly 50 can thus be assembled at a remote, off-assembly line, location and then brought to the assembly line for attachment to the pump 28. This separate integral filter assembly 50 allows simple model differentiation on the assembly line. For example, dishwashers having either large object straining and small particle filtering as with filter assembly 50 or having only a strainer cap (not shown) for large object straining capacity can be selectively provided without changing any portion of the pump 28.

The preferred embodiment of the invention has been set forth in the drawings and specifications, and although specific terms are employed, these are used in a generic or descriptive sense only and are not used for purposes of limitation. Changes in the form and proportion of parts as well as in the substitution of equivalence are contemplated as circumstances may suggest or render expedient without departing from the spirit or scope of the invention as further defined in the following claims.

What is claimed is:

1. A water circulation system for a dishwasher having a washing chamber, a pump housing, a pump within the housing for supplying wash water to the washing chamber to clean objects therein, the system comprising:

a strainer for straining large objects from the wash water and defining a first water recycling inlet into the pump housing for recirculation of wash water to the washing chamber by the pump;

a filter for filtering food particles from the wash water and defining a second water recycling inlet into the pump housing for recirculation of wash water to the washing chamber by the pump;

a collection chamber adjacent the filter for collecting food particles filtered from the wash water; and a cylindrical member having a side wall and a bottom wall between the strainer and the filter, by cylindrical member defining the collection chamber.

2. The water circulation system of claim 1 wherein the collection chamber includes an outlet for discharging food particles from the collection chamber, and closure means movable between open and closed positions with respect to the outlet.

3. The washing circulation system of claim 2 wherein the closure means is normally in the closed position.

4. The water circulation system of claim 2 wherein the collection chamber includes a ramp section leading downwardly to the outlet.

5. The water circulation system of claim 1 wherein the bottom wall includes a downwardly sloped section having a lower end with a discharge outlet at the lower end, the system further comprising closure means for normally closing the discharge outlet and being movable to an open position such that food particles collected in the collection chamber are discharged through the outlet.

6. The water circulation system of claim 5 wherein the closure means further includes a protrusion extending into the outlet for initiating the flow of collected food particles as the closure means is moved to the open position.

7. The water circulation system of claim 1 further comprising backwash means for backwashing the filter to prevent clogging thereof.

8. The water circulation system of claim 7 wherein the pump is operatively connected to a rotatable conduit which supports a wash arm for directing water from the pump through the conduit and wash arm onto the objects to be washed, the filter surrounding the conduit, the backwash means being an aperture in the conduit to direct a spray of water at the filter while the conduit rotates.

9. The water circulation system of claim 1 wherein the collection chamber includes a flush port for receiving water from the pump to flush food particles from the collection chamber.

10. The water circulation system of claim 1 further comprising a cap overlying the collection chamber for directing wash water with food particles into the collection chamber for filtration of the wash water through the filter.

11. Combined straining and filtering apparatus for a dishwasher, the dishwasher having washing fluid circulating means associated with a bottom wall of a dishwashing chamber and including a fluid outlet to a rotatable wash arm for directing washing fluid onto dishes to be washed in the dishwashing chamber comprising:

a cover associated with the fluid circulating means including a strainer portion defining a first fluid inlet to the fluid circulating means for straining large objects from the washing fluid, the cover further including a cylindrical wall extending upward from the strainer portion and a radially inwardly directed bottom wall with a central opening surrounding the fluid outlet;

a filter element mounted on the bottom wall of the cover and extending upwardly therefrom, the cylindrical wall, the bottom wall and the filter element defining an upwardly opening collecting chamber including an egress opening; and a cap overlying the filter element and having a central opening coaxial with the fluid outlet, the cap including a sloping surface for directing washing fluid and food particles into the collecting chamber such that the washing fluid filters through the filter element, the filter element providing a second fluid inlet to the fluid circulating means with filtered particles being retained in the collecting chamber.

12. The apparatus of claim 11 further comprising a closure flap movable between open and closed positions relative to the egress opening of the collecting chamber.

13. The apparatus of claim 11 wherein the collecting chamber includes a downwardly sloped portion leading to the egress opening.

14. The apparatus of claim 11 further comprising a backwashing means associated with the fluid circulation means for backwashing the filter element.

15. The apparatus of claim 11 further comprising flush means associated with the fluid circulation means for periodically flushing the collecting chamber with washing fluid to remove the filtered particles therefrom.

16. The apparatus of claim 11 wherein the filter element is annular and surrounds the fluid outlet.

17. The apparatus of claim 11 wherein the cover with the strainer, the filter element and the cap are an integral assembly adapted for use with the fluid circulating means.

18. A water circulation system for a dishwasher having a washing chamber, a pump housing, a pump within the housing for supplying wash water to the washing chamber to clean objects therein, the system comprising:

a strainer for straining large objects from the wash water and defining a first water recycling inlet into the pump housing for recirculation of wash water to the washing chamber by the pump;

a filter for filtering food particles from the wash water and defining a second water recycling inlet into the pump housing for recirculation of wash water to the washing chamber by the pump;

a collection chamber adjacent the filter for collecting food particles filtered from the wash water;

backwash means for backwashing the filter to prevent clogging thereof; and the pump being operatively connected to a rotatable conduit which supports a wash arm for directing water from the pump through the conduit and wash arm onto the objects to be washed, the filter surrounding the conduit, the backwash means being an aperture in the conduit to direct a spray of water at the filter while the conduit rotates.

* * * * *